United States Patent [19]

Higginbotham et al.

[11] 4,054,723

[45] Oct. 18, 1977

[54] COMPOSITE ARTICLES

[75] Inventors: Gordon John Spencer Higginbotham, Darley Abbey; John Wolverson, Hilton, both of England

[73] Assignee: Rolls-Royce Limited, London, England

[21] Appl. No.: 604,117

[22] Filed: Aug. 13, 1975

Related U.S. Application Data

[63] Continuation of Ser. No. 412,803, Nov. 5, 1973, abandoned.

[30] Foreign Application Priority Data

Nov. 8, 1972 United Kingdom ..... 51405/72

[51] Int. Cl.[2] ..... B32B 15/00

[52] U.S. Cl. ..... 428/678; 75/171; 428/680

[58] Field of Search ..... 29/194; 75/171, 170; 428/678, 680

[56] References Cited

U.S. PATENT DOCUMENTS

| | | | |
|---|---|---|---|
| 3,620,693 | 11/1971 | Sama et al. | 29/194 |
| 3,741,791 | 6/1973 | Maxwell et al. | 29/194 |

*Primary Examiner*—R. Dean

*Attorney, Agent, or Firm*—Cushman, Darby & Cushman

[57] ABSTRACT

An alloy specifically adapted for use as a coating on a nickel-base or cobalt-base superalloys consists of in weight about 12.5% to about 20% Chromium, about 2% to about 10% Silicon, about 2% to about 8% Aluminium, optionally up to about 10% Titanium, optionally up to about 0.25% from the group comprising Yttrium and the other rare earth metals, optionally up to about 20% Iron, optionally up to about 4% Niobium, optionally up to about 4% Molybdenum, optionally up to about 5% Manganese, the Iron, Niobium, Molybdenum and Manganese being present singly or in combinations such as to produce little or no deleterious effect on the corrosion resistance, the balance comprising essentially Nickel or Cobalt or a combination of these two, and impurities.

8 Claims, No Drawings

COMPOSITE ARTICLES

This is a continuation of Ser. No. 412,803 filed Nov. 5, 1973 abandoned.

This invention relates to an alloy composition, and comprises an alloy composition adapted for use as an overlay coating to be applied to high temperature resistant nickel or cobalt-base superalloy articles.

Throughout this specification, where the constituents of an alloy are referred to as a percentage, it should be understood that this is a percentage by weight.

Articles of high temperature resistant nickel or cobalt-base alloy have been relatively susceptible to high temperature corrosion, particularly when the ambient atmosphere is salt-laden.

An instance of such conditions occurs when a gas turbine engine having nozzle guide vanes of nickel or cobalt-base alloy operates in marine conditions. It has been standard practice to provide such articles with a coating which helps protect the base metal against corrosion. However, the coatings presently used are not uniformly satisfactory for the following reasons;

1. Higher temperatures in zero engines are exceeding the temperature capabilities of current coatings and coating lives are proving inadequate.

2. Present coatings have insufficient sulphidation resistance to combat marine and industrial environments. (Sulphidation is the main form of corrosion of the articles in question when operated in marine or other atmospheres at temperatures about 700°-900° C).

3. Present coatings are relatively brittle and tend to crack under cyclic operation.

4. New high strength cast alloys have, in general, less corrosion resistance than their wrought counterparts and therefore need more reliable coatings.

Operating conditions for different articles are becoming so varied that no single coating can be expected to give optimum performance in all conditions of service. It is becoming apparent that different coatings are required to suit different conditions.

Aluminising is, at present, used in most conditions but this coating is limited by the factors described above.

Certain modern overlay coatings provide an improvement on aluminising in that they possess far greater sulphidation resistance and less tendency to cracking. However, these coatins are still relatively brittle and some have a practical temperature limitation of about 1050° C.

We have now discovered a range of coating alloys within which compositions may be chosen to have the following properties: coatings may be chosen which particularly suit the sulphidising (lower temperature) or oxidising conditions, coating compositions may be chosen to bear a closer relationship to the base alloy composition, when this is one of the nickel or cobalt base superalloys, than do the coatings presently used. This can result in slower interdiffusion and therefore longer life.

coating alloys may be chosen which are more ductile than presently used coatings and therefore which have less tendency to crack, since the coatings are overlay coatings their as-coated compositions are not influenced by the base alloy characterstics to the same degree as the diffusion coatings.

According to the present invention an alloy adapted for use as a coating on a nickel-base or cobalt-base superally comprises from 12.5 to 20% by weight Chromium, from 2% to 10% Silicon, from 2% to 8% Aluminium, from 0 to 10% Titanium, from 0 to 0.25% Yttrium, from 0 to 20% Iron, from 0 to 4% Niobium, from 0 to 4% Molybdenum, from 0 to 5% Manganese, Iron, Niobium, Molybdenum or Manganese being present singly or in combinations such as to produce little or no deleterious effect on the corrosion resistance, from 0 to 83.5% Cobalt, and from 0 to balance of Nickel, the remainder being impurities.

In our preferred compositions there is from 14% to 16% Chromium, from 4% to 6% Silicon, from 4% to 6% Aluminium and from 3% to 6% Titanium.

The invention also comprises a nickel-base or cobalt-base alloy coated with an alloy according to the above statements.

The invention is illustrated in the following table of examples, in which examples 4–14 are in accordance with the invention.

| Alloy | Constitutents % by weight | | Depth of corrosion in thousandths of an inch at Treatment Temp. 870° C | 1050° C |
|---|---|---|---|---|
| 1 | Typical superalloy | | 24.0 | 10.0 |
| 2 | 24Al, 7.5Cr, 17Co, 1Mo, 0.5Ti, | balance Ni | 2.0 | 4.7 |
| 3 | 30Al, 8Cr, 15Co, 4Mo, | balance Ni | 5.4 | 7.7 |
| 4 | 20Fe, 15Cr, 5Si, 5Al, 4Ti, | balance Ni | 0.7 | 0.1 |
| 5 | 15Co, 15Cr, 5Si, 5Al, 4Ti, 4Mo | balance Ni | 0.7 | 0.35 |
| 6 | 15Cr, 5Si, 5Al, 4Nb, | balacne Ni | 0.5 | .2 |
| 7 | 15Cr, 5Si, 5Al, 4Ti | balance Ni | 1.1 | 0 |
| 8 | 15Cr, 5Si, 5Al, 4Ti | balance Co | 0.5 | 0 |
| 9 | 15Cr, 15Co, 5Si, 5Al, 4Ti | balance Ni | 1.0 | 0.2 |
| 10 | 15Cr, 5Si, 5Al, 4Ti, 0.25 Y | balance Ni | 0.9 | 0.35 |
| 11 | 15Cr, 2.5Si, 7.5Al, 6Ti | balance Ni | 1.0 | 4.35 |
| 12 | 15Cr, 7.5Si, 7.5Al, 6Ti | balance Ni | 0 | 2.4 |
| 13 | 15Cr, 2.5Si, 2.5Al, 6Ti | balance Ni | 0.9 | 6.25 |
| 14 | 15cr, 5Si, 5Al | balance Ni | 0.3 | 9.0 |
| 15 | 15Cr, 4Al, 4Ti | balance Ni | 40.75 | 9.30 |
| 16 | 15Cr, 5Si, 5Ti | balance Ni | 2.50 | 4.45 |
| 17 | 15Cr, 5Si, 5Al, 4Ti, 0.5Y | balance Ni | 1.4 | 2.8 |
| 18 | 15Cr, 5Si, 5Al, 4Ti, 1Y | balance Ni | 1.5 | 3.4 |
| 19 | 19Cr, 10Si | balance Ni | 1.6 | 140.0 |
| 20 | 20Cr, 12Al, 0.5Y | balance Co | 0 | 2.55 |

The alloys referred to in the table were tested as follows; a test piece was made of the alloy composition in question and was exposed for 100 hours, in the efflux of the combustion chamber of a gas turbine engine, at the temperature in question with a fixed number of cycles to room temperature during each test. To reproduce a marine atmosphere, sunthetic sea salt was injected upstream of the chamber at an approximate rate of 4 parts per million by weight of salt in the mass airflow. Corrosion was then assessed by metallographic section and measurement of the depth of corrosion in the test piece; this depth in thousandths of an inch is expressed in the table.

It will be understood by those skilled in the art that at the lower test temperature the main attack on the metal is due to sodium salts present in the sea salt and sulphur present in the gas turbine fuel. At the higher temperature the sulphidation attack is no longer the major problem, and oxidation becomes the most prevalent form of attack.

In the table, alloy 1 is a typical high strength cast nickel-based superalloy, and the results for this alloy form a first baseline with which the remaining alloys may be compared. Alloys 2 and 3 are attempts to duplicate the composition of the coating formed when the surface of a nickel-based superalloy is aluminised by one of the prior art processes; it will be seen that these differ mainly in aluminum content, and in fact the aluminium content of such coatings varies considerably with use. These alloys are a considerable improvement over the bare superalloys.

Alloys 4–14 are all within the scope of the present invention, and it will be noted that they are all considerably better at one or other of the sulphidation or oxidation conditions or both than the aluminsed coating compositions.

Alloys 15 and 16 are intended to demonstrate the effect of leaving out certain constituents, referred to below, while alloys 17 and 18 demonstrate the effect of adding excess Yttrium to a coating in accordance with the invention.

Alloys 19 and 20 may be taken as indicative of the present state of the art in coatings; 19 is a coating useful against sulphidation while 20 is an expensive modern coating which is reasonably effective against both sulphidation and oxidation.

It will be seen that the alloys of the invention use a particular balance of silicon and aluminium, with in some cases titanium, in a nickel/chromium or cobalt/-chromium matrix.

We have found that using this balance of constituents, the oxidation resistance of an alloy may be improved, although the alloy may not have sufficient strength to be used by itself as an engineering material. The reasons for the ranges of alloys we believe to be particularly useful are set out below with reference to the examples.

With regard to the amounts of nickel and cobalt included, we believe that these elements are substantially interchangeable in the system. However, the cobalt-based coatings have slightly better sulphidation resistance as can be seen from examples 7, 8 and 9. Consequently, we believe that either the cobalt or the nickel may be interchangeably used from 0 to balance; or as expressed in the claims, the cobalt may vary from 0 to 83.5% while the nickel varies from 0 to balance.

Work on commercial alloys indicates that reducing the chromium content to less than 12.5% is detrimental to corrosion resistance, and this is borne out by work on simple alloys which also indicates a practical upper limit of 20%. The chromium content is therefore made between 12.5% and 20%.

Silicon has been shown to contribute the most toward corrosion resistance and tests have shown that a minimum of 2% is required to promote the beneficial interaction with aluminium. Increasing the silicon content lowers the solidus temperature of the coating alloy, and to keep this temperature at a practical level an upper limit of 10% has been found to be necessary. The range for silicon is thus 2% to 10% as a minimum; we find that the best results are produced in the range 4% to 6%. Alloy 15 indicates the detrimental effect of leaving out all silicon, while alloys 11, 12 and 13 which are toward the end of our ranges for silicon show that the corrosion resistance is markedly worse as the silicon constituent tends toward our limits. Thus the alloy 15 is worse than the bare superalloy 1; alloy 11 is markedly better while alloy 7 is better still.

The lower limit of 2% for aluminium is determined on the same basis as was the light for silicon, the combination of these elements being necessary for improved corrosion resistance. An upper limit of 8% has been set firstly to retain an acceptable degree of ductility in the coating alloy and secondly to maintain the aluminium level as near to that of commercially available superalloys as possible, the preferred range being 4%–6%. Alloys 11 and 13 in the accompanying table demonstrate the effect of reducing the aluminum content to about the limit of our range, where it will be seen that the resistance to corrosion begins to fall off.

It has been demonstrated (see alloy 14) that titanium is not necessary for an alloy only required to have sulphidation resistance; therefore the minimum titanium level is set at zero. Amounts up to 6% have shown an improvement in oxidation resistance due to the presence of titanium (c/f alloy 7). We believe that titanium may be added up to 10%, which is a practical limit to maintain ductility and solidus temperature. The titanium range is thus 0–10%, with a preferred range of 3% to 6%.

Current literature states that yttrium added to superalloys can be beneficial to corrosion resistance particularly under cyclic conditions. The addition of 0.25% yttrium to a preferred composition (see alloy 10) produced in our tests a slight improvement in sulphidation resistance and a drop in oxidation resistance. Additions of 0.5% and 1% yttrium to the same composition (alloys 17 and 18) caused a progressive reduction in corrosion resistance at both higher and lower temperature conditions. We therefore believe that any benefit to be gained by the addition of yttrium will lie with additions in the range 0 to 0.25%.

We also believe that other elements may be added to the system to modify properties as desired. Thus we believe that iron up to about 20%, niobium up to 4% molybdenum up to 4% and manganese up to 5% may be added separately without making the resulting alloy useless.

It should be noted that if all these additions were made together, the resulting alloy may have poor corrosion resistance, and the decision on what amounts in combination may be added should be within the scope of one skilled in the art.

Alloys 4, 5 and 6 show that additions of iron, molybdenum and niobium in the amounts we specify do not catastrophically affect the properties of the resulting alloy.

It should be noted that as in normal commercial alloys, it is impossible to produce the alloys of the invention without some impurities being present; thus in particular Carbon may be present in small quantities. Again, in some circumstances it may be possible to repalce the Yttrium when present in out alloys with other rare earth elements.

The alloys in accordance with the invention may be coated on to the base material by any one of the known coating methods for alloys, which include flame or plasma spraying, brazing or vacuum evaporation. However, we have used a brazing technique in which the alloy is pulverized, adhered to the surface of the article to be coated, and heated to drive off the adherent substance and to melt the alloy on the surface.

It will be seen that due to the interchangeability of Nickel and Cobalt in the present alloys, and due to the choice of the quantities of Aluminium and Titanium, the coating alloys of the invention have quantities of constituents which are quite close to those of commercial alloys; this helps to reduce diffusion and consequent degradation of the properties of the base material and coating. However, as will be appreciated by those skilled in the art, if a Nickel-based coating is used on a Cobalt-based base alloy or vice-versa, the diffusion occurring in service is likely to considerably shorten the life of the coating and this situation should be avoided. Again, it will be seen that within the invention coating alloys may be chosen which are particularly useful for operation in either the sulphidation (e.g. alloy 12) or the oxidation (e.g. alloy 7) regimes, although some preferred alloys (alloys 7 and 8) are very good in both regimes.

We claim:

1. A nickel-base or cobalt-base superalloy having an alloy coating thereon consisting essentially of, in weight percent, about 12.5% to about 20% Chromium, about 4% to about 6% Silicon, about 2% to about 8% Aluminium, about 3% to about 6% Titanium, optionally up to about 0.25% from the group consisting of Ytrrium and the other rare earth metals, optionally up to about 20% Iron, optionally up to about 4% Niobium, optionally up to about 4% Molybdenum, optionally up to about 5% Manganese, the Iron, Niobium, Molybdenum or Manganese being present singly or in combinations such as to produce little or no deleterious effect on the corrosion resistance, the balance of said coating alloy being essentially Cobalt or Nickel, or a combination of these two, together with small amounts of impurities and incidental elements which do not detrimentally affect the basic characteristics of the coating alloy.

2. A coated article as claimed in claim 2 and which said alloy coating contains about 14% to about 16% Chromium.

3. A coated article as claimed in claim 1 and which contains about 4% to about 6% Aluminium.

4. A nickel-base or cobalt-base superally having an alloy coating thereon consisting essentially of, in weight percent about 14% to about 16% Chromium, about 4% to about 6% Silicon, about 4% to about 6% Aluminium, about 3% to about 6% Titanium, optionally up to about 0.25% Yttrium, optionally up to about 20% the Iron, optionally up to about 4% Niobium, optionally up to about 4% Molybdenum, optionally up to about 5% Manganese, Iron, Niobium, Molybdenum or Manganese being present singly or in combinations which do not detrimentally affect the corrosion resistance of the alloy coating, the balance being essentially Cobalt or Nickel singly or in combination together with small amounts of impurities and incidental elements which do not detrimentally affect the basic characteristics of the alloy coating.

5. A nickel-base or cobalt-base superalloy having an alloy coating thereon consisting essentially of by weight percent about 15% Chromium, about 5% Silicon, about 5% Aluminium, and about 4% Titanium, the balance being essentially Nickel together with small amounts of impurities and incidental elements which do not detrimentally affect the basic characteristics of the alloy coating.

6. A nickel-base or cobalt-base superalloy having an alloy coating thereon consisting essentially of by weight percent about 15% Chromium, about 5% Silicon, about 5% Aluminium, and about 4% Titanium, the balance being essentially Cobalt together with small amounts of impurities and incidental elements which do not detrimentally effect the basic characteristics of the alloy coating.

7. A nickel-base or cobalt-base superalloy having an alloy coating thereon consisting essentially of by weight percent about 15% Cobalt, about 15% Chromium, about 5% Silicon, about 5% Aluminium, and about 4% Titanium, the balance being essentially Nickel together with small amounts of impurities and incidental elements which do not detrimentally affect the basic characteristics of the alloy coating.

8. A nickel-base or cobalt-base superalloy having an alloy coating thereon consisting essentially of by weight percent about 15% Chromium, about 5% Silicon, about 5% Aluminium, about 4% Titanium and about 0.25% Yttrium, the balance being essentially Nickel together with small amounts of impurities and incidental elements which do not detrimentally affect the basic characterics of the alloy coating.

* * * * *